United States Patent [19]

Svehaug

[11] 4,277,857

[45] Jul. 14, 1981

[54] ROCKING MECHANISM FOR BEDS

[76] Inventor: Oswald C. Svehaug, 780 Gretchen Rd., Chula Vista, Calif. 92010

[21] Appl. No.: 97,923

[22] Filed: Nov. 28, 1979

[51] Int. Cl.[3] ..... A47D 9/02

[52] U.S. Cl. ..... 5/62; 5/108; 128/33

[58] Field of Search ..... 5/61, 62, 108, 109; 248/370; 128/33

[56] References Cited

U.S. PATENT DOCUMENTS

| | | | |
|---|---|---|---|
| 3,022,520 | 2/1962 | Fingu | 5/109 |
| 3,619,826 | 11/1971 | Lizotte, Sr. | 5/109 |
| 3,992,731 | 11/1976 | Carswell | 5/109 |
| 4,028,753 | 6/1977 | Rios | 5/108 |

*Primary Examiner*—Casmir A. Nunberg

*Attorney, Agent, or Firm*—Henri J. A. Charmasson

[57] ABSTRACT

An apparatus for applying a rocking motion to a bed foundation, or the like, which comprises a movable frame (2) supporting the foundation, first and second spaced apart guiding structures (3) located preferably under the frame. Each guiding structure having a pair of traveling surfaces (6,7) slanted downwardly toward the similar surfaces of the other guiding structure. Rollers (5) attached to the frame rest upon said traveling surfaces. An electrical motor (21) imparts to the movable frame, a reciprocal movement along and between said guiding structures.

5 Claims, 10 Drawing Figures

ROCKING MECHANISM FOR BEDS

TECHNICAL FIELD

This invention relates generally to rocking mechanisms for beds, cribs, and the like, and more particularly to attachments designed to impart a tiltable movement to a bed for therapeutical purposes.

It has long been recognized that the imparting of a tilting movement to a bed around a virtual axis of rotation perpendicular to the direction of the body resting on the bed stimulates the blood circulation. The periodical tilting of the resting body increases relaxation and in the case of bed ridden patients may reduce the risk of bed sores or necrosis due to schemia in those portions of the body in direct contact with the bed.

BACKGROUND ART

U.S. Pat. No. 4,114,209, Sandlin, discloses a tilting attachment for a bed in order to achieve those results. Sandlin further recognized the importance of shifting the axis about which the patient pivots near the position of the body in order to avoid any unpleasant swaying sensation caused by lateral displacement when the pivotal point is located below the foundation as for instance in the device disclosed in U.S. Pat. No. 4,152,795, Rodosta, et al. However, the design taught by Sandlin extends the tilting mechanism up to the level of the axis of rotation thus creating an unsightly and cumbersome apparatus. It would be highly preferable to devise a bed tilting attachment which can be hidden under the bed such as the Rodosta device, but which would create a tilting motion around an axis of rotation located much higher, and if possible, near the location of the body lying on the bed.

SUMMARY OF THE INVENTION

An apparatus is provided to apply a tilting motion to a bed about a virtual axis of rotation located transversally to the position of the body resting on the bed and at the same elevation in order to avoid unplesant swaying movement of the body. The apparatus comprises a movable frame supported by four rollers riding over four guiding structures located under the four corners of the frame. The front and back pairs of guiding structures are slanted downward toward one another. An electrical motor is used to impart a rocking motion to the frame in relation to the guiding structure.

Means are provided for adjusting the amplitude of the rocking movement and for quickly returning the bed to the horizontal home position upon switching off the power drive.

DESCRIPTION OF THE PREFERRED EMBODIMENT OF THE INVENTION

Figure 1:
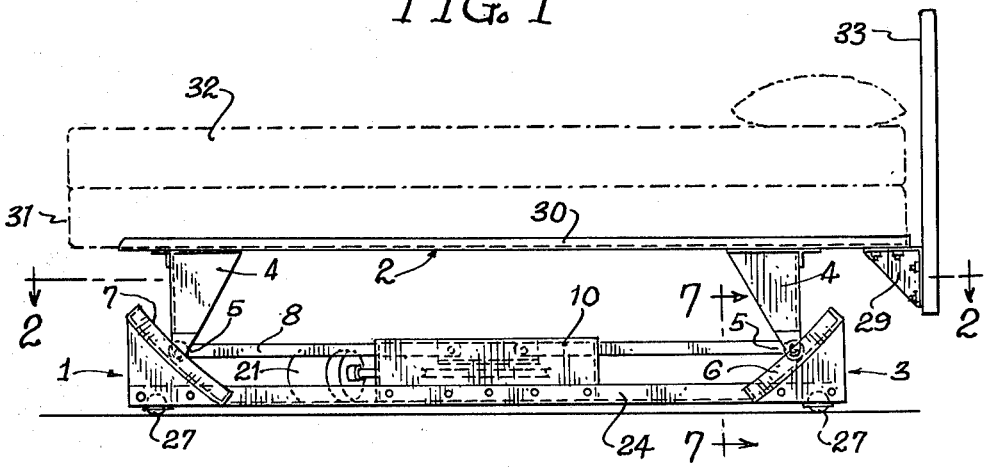
FIG. 1 is a side elevational view of the bed rocking mechanism.
Figure 2:
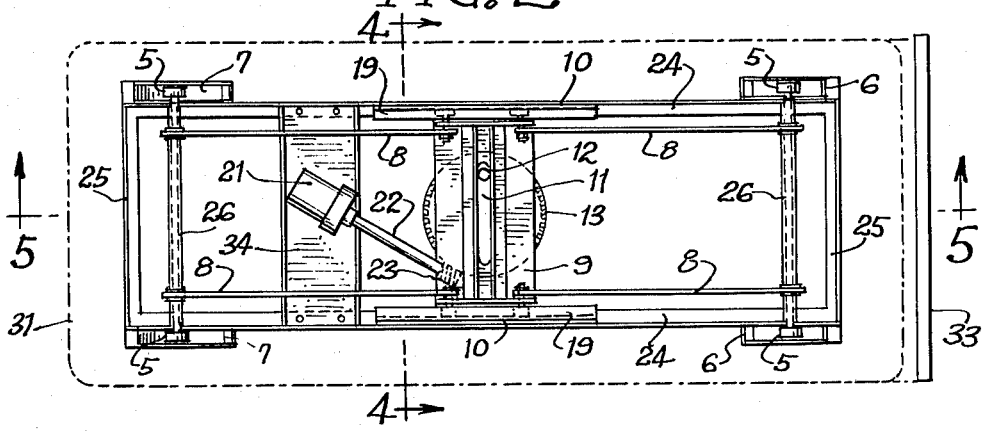
FIG. 2 is a cross sectional view taken along lines 2—2 of FIG. 1.
Figure 3:
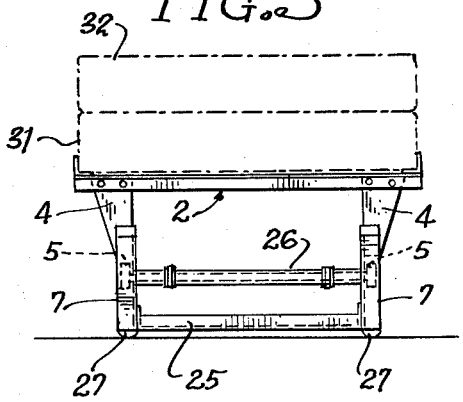
FIG. 3 is a front elevational view of the bed rocking mechanism.

Referring now to the drawing there is illustrated a bed rocking mechanism 1 implemented according to the present invention. The rocking mechanism comprises a foundation supporting frame 2 designed to oscillate over a stationary base 3. The frame 2 comprises a pair of parallely spaced apart, angular rails 30 supporting a box spring 31 and mattress 32 shown in dotted lines. A headboard 33 is mounted on the rails 30 by means of a pair of angle brackets 29. A pair of trussed feet 4 extend from each rails, and are terminated by a nylon roller 5 in contact with the stationary base 3.

The stationary base 3 is built on a rectangular frame made of two parallel longitudinal angular elements 24 and transversal end members 25. The rectangular frame is supported on four low-profile casters 27 which provide some mobility to the entire structure. At each corner of the frame and immediately under each foot 4, is a guiding structure comprising a slanted track 6 and 7 traveled by one of the rollers 5. The head-side tracks 6 are slanted downward toward the foot of the bed while the foot-end tracks 7 are slanted downward toward the head of the bed. In the home position the feet 4 are positioned exactly in the middle of the tracks 6 and 7. Each pair of head and foot rollers 5 are connected by a axial shaft 26. The shaft 26 is connected by means of two pairs of rods 8 to a traveling carriage 9 mounted transversally in the middle of the stationary base 3. The rods 8 are provided with a pivotal connection at both their shaft and carriage extremities.

Figure 4:
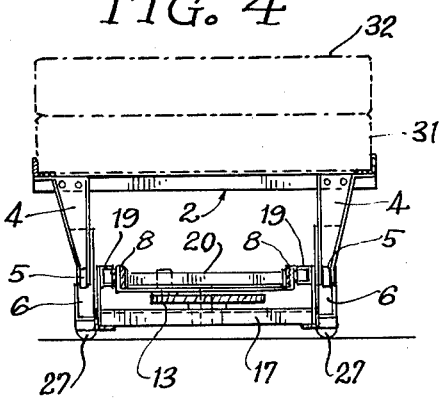
FIG. 4 is a cross sectional view taken along line 4—4 of FIG. 2.
Figure 6:
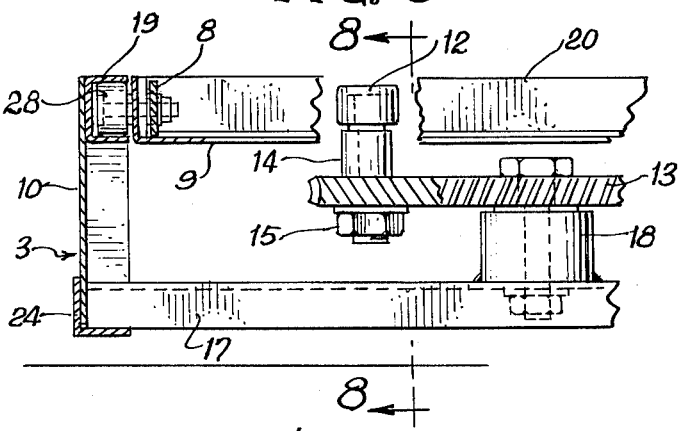
FIG. 6 is a partial cross sectional view of the driving mechanism taken along line 6—6 of FIG. 5.
Figure 7:
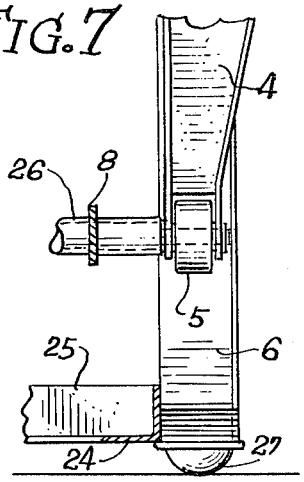
FIG. 7 is a partial cross sectional view of one of the four rocking guides taken along line 7—7 of FIG. 1.
Figure 8:
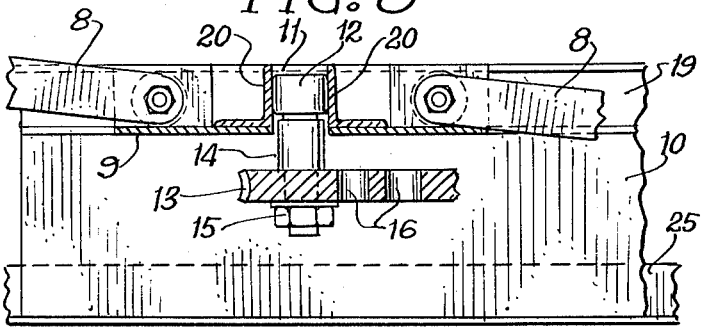
FIG. 8 is a partial cross sectional view of the driving mechanism taken along lines 8—8 of FIG. 6.
Figure 9:
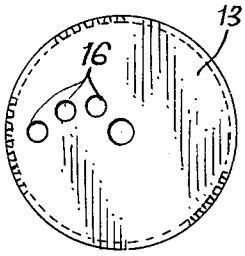
FIG. 9 is a top plan view of the driving spur gear.

As more specifically shown in FIGS. 4 and 6, the traveling carriage 9 is supported by two pairs of ball bearing rollers 28 on each side of the carriage. The rollers 28 are engaged into a U-shaped guide 19 supported by lateral plates 10 welded to the longitudinal members 24. The carriage 9 is driven back and forth between the lateral guides 19 under the action of a cam 14 traveling within a slot 11 in the middle of the carriage 9. The cam 14 comprises a ball bearing roller 12 in contact with the carriage 9 and is mounted on a spur wheel 13 and secured thereon by screw 15. The spur wheel 13 is mounted horizontally under the carriage 9 on a cross beam 17 bridging the two lateral beams 24. The wheel 13 is driven by a worm gear 23 mounted on a shaft 22 coupled to an electrical motor 21. The motor 21 is installed on a cross plate 34 between the two lateral beams 24.

Figure 5:
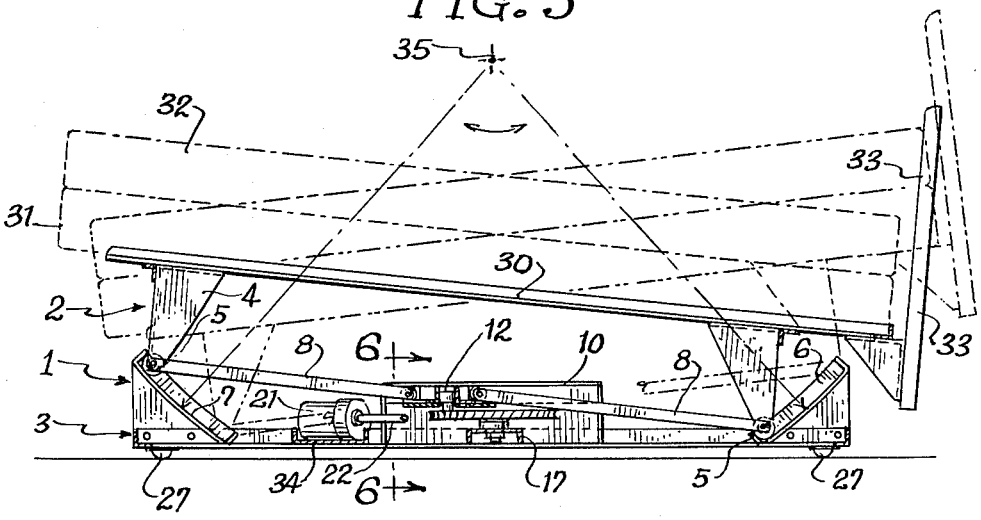
FIG. 5 is a cross sectional view taken along line 5—5 of FIG. 2 showing the foundation supporting frame in the maximum tilting position.

It can be understood that the rotational movement of the motor 21 imparts through the mechanism just described a reciprocal movement to the carriage 9. This reciprocal movement is in turn applied to the foundation supporting frame 2 by the four rods 8. The rollers 5 at the end of the feet 4 are made to travel up and down inclined tracks 6 and 7 causing the foundation supporting frame to follow a periodical tilting movement best illustrated in FIG. 5. The rollers 5 are preferably made of nylon or other synthetic materials for quiet operation.

It should be noted that because of the particular geometry of the guiding tracks 6 and 7, the foundation supporting frame 2 appears to be pivoting around a virtual axis 35 located above the spring 31 and mattress 32 and at the same level as the body of a person lying on the bed. The location of the virtual axis 35 could be shifted in relation to the position of the body by changing the position of the feet 4 along the side rails 30 as well as their sizes. The amplitude of the oscillating movement can be modified by changing the position of cam 14 on the spur gear 13; three holes 16 are provided on the spur gear 13 to that effect.

Figure 10:
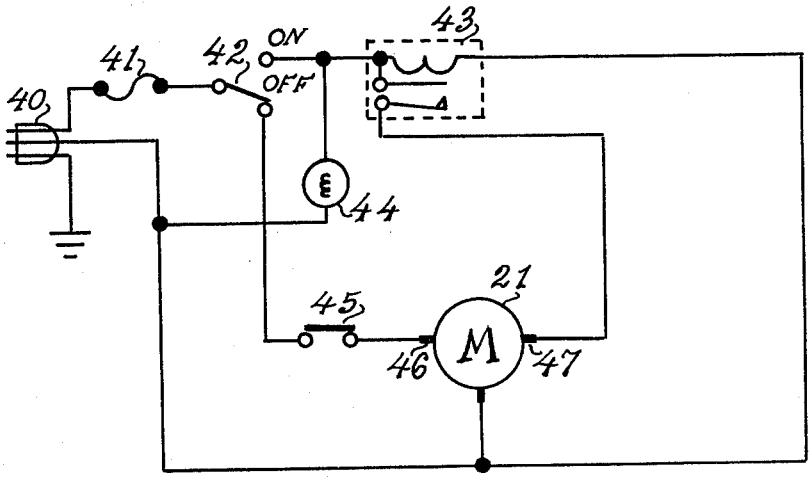
FIG. 10 is a schematic of the electrical system.

It has been determined that the maximum relaxation can be obtained with such structure by imparting a very low oscillating motion to the bed of several minutes per cycle. Control of the driving mechanism can best be understood by reference to FIG. 10. Power for the system is derived from any household AC electrical outlet through plug 40. Power supply is run through fuse 41 to an on/off switch 42. A light 44 indicates when the system has been energized. An adjustable delaying relay 43 postpones the activation of the motor 21 for the selected number of minutes in order to provide time for the subject to fall asleep before the oscillating movement begins. Motor 21 is a dual speed type. The high speed operation can be obtained by energizing terminal 46. The low speed operation can be obtained by energizing terminal 47. The normal rocking movement is provided by the low speed operation of the motor 21. Home switch 45 is normally open when the bed is in the home, that is horizontal median, position. When the on/off switch 42 is flipped to the off position, the high speed terminal 46 will be energized through switch 45 if the bed is not in the home position. The motor 21 will then switch to the high speed operation quickly returning the bed toward the horizontal position until switch 45 opens again.

While the preferred embodiment of the invention has been described, and modifications have been suggested, other embodiments may be designed and changes may be made without departing the spirit of the invention and the scope of the appended claims.

What is claimed is:

1. An apparatus for imparting a rocking motion of a bed foundation or the like which comprises:

(a) a movable frame defining a longitudinal direction;

(b) first and second longitudinally spaced apart guiding structures, each said guiding structure having at least one traveling surface slanted downwardly toward the other structure;

(c) means for slidingly connecting the movable frame to said traveling surfaces; and (d) means for imparting a gentle longitudinal reciprocating movement to the movable frame along said guiding structure whereby a slow motion generally rotational about a horizontal virtual axis perpendicular to said longitudinal direction is imparted to said frame.

2. The apparatus claimed in claim 1 wherein said virtual axis passes substantially through the body of a person lying on said bed such that said person is virtually free of any translational motion components.

3. The apparatus claimed in claim 1 or 2 wherein said means for imparting reciprocating movement comprises:

(a) a dual speed electrical motor;

(b) means for translating the rotary motion of said motor into longitudinal movement of said frame;

(c) a switch for switching the motor on and off;

(d) means for delaying the activation of the motor upon activating said switch;

(e) means for changing the speed of the motor upon turning said switch off; and (f) means to maintain said changed motor speed until the movable frame has returned to a horizontal home position.

4. Structure according to claim 1 wherein said means for imparting reciprocating movement has a movement cycle speed sufficiently slow that said rotational motion is imperceptible to one asleep on said bed.

5. Structure according to claim 4 wherein said cycle speed is on the order of five minutes.

* * * * *